US011493304B1

(12) United States Patent
Kemper et al.

(10) Patent No.: US 11,493,304 B1
(45) Date of Patent: Nov. 8, 2022

(54) DIOPTER ADJUSTMENT FOR OPTICAL DEVICE WITH OVERLAPPING LEFT-HANDED AND RIGHT-HANDED THREADS

(71) Applicant: Leupold & Stevens, Inc., Beaverton, OR (US)

(72) Inventors: Curtis J. Kemper, Sherwood, OR (US); Timothy J. Lesser, Forest Grove, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 17/239,526

(22) Filed: Apr. 23, 2021

(51) Int. Cl.
*F41G 1/26* (2006.01)
*F41G 1/14* (2006.01)

(52) U.S. Cl.
CPC ..... *F41G 1/26* (2013.01); *F41G 1/14* (2013.01)

(58) Field of Classification Search
CPC ..... F41G 1/26; F41G 1/14; F41G 1/38
USPC ..... 42/137, 111, 119, 120, 122, 130
See application file for complete search history.

(56) References Cited

U.S. PATENT DOCUMENTS

| | | | | |
|---|---|---|---|---|
| 522,888 | A | 7/1894 | French et al. | |
| 600,748 | A | 3/1898 | Smart | |
| 829,363 | A | 8/1906 | Berry | |
| 3,203,331 | A * | 8/1965 | Hofmann | G03B 9/08 396/510 |
| 3,332,329 | A * | 7/1967 | Singer | G03B 7/06 396/65 |
| 3,854,350 | A | 12/1974 | Bauer et al. | |
| 3,890,053 | A | 6/1975 | Strecker | |
| 7,217,195 | B2 | 5/2007 | Matsubayashi | |
| 8,292,243 | B2 | 10/2012 | Shaffer | |
| 2006/0236740 | A1 | 10/2006 | Matsubayashi | |

(Continued)

FOREIGN PATENT DOCUMENTS

| | | | |
|---|---|---|---|
| CN | 1078774 | A | 11/1993 |
| CN | 201637917 | U * | 11/2010 |

OTHER PUBLICATIONS

Scott Elliott, Its' Nuts! Nuts go two ways on one screw thread, https://www.youtube.com/watch?v=o-fPsvqjqZI, Aug. 29, 2011, entire video.

(Continued)

*Primary Examiner* — John Cooper
(74) *Attorney, Agent, or Firm* — Schwabe, Williamson & Wyatt, PC

(57) ABSTRACT

A diopter adjustment device for an optical device such as a riflescope includes a first tubular member having overlapping left-handed and right-handed external threads, a second tubular member has internal threads mated with either the left-handed or right-handed external threads of the first tubular member, and a stop nut threaded onto the first tubular member via internal threads that are of opposite handedness as the internal threads of the second tubular member. A diopter lens is mounted in one of the first and second tubular members and movable therewith relative to the other of the first and second tubular members to adjust a diopter setting or focus of the optical device. Because the internal threads of the nut and the second tubular member have opposite handedness, the nut provides greater resistance to inward movement of the diopter lens than conventional locking diopter adjustments.

14 Claims, 4 Drawing Sheets

(56) References Cited

U.S. PATENT DOCUMENTS

| | | | | |
|---|---|---|---|---|
| 2007/0103647 | A1* | 5/2007 | Egawa | G03B 21/16 353/54 |
| 2011/0262245 | A1* | 10/2011 | Michiwaki | F16B 39/32 411/432 |
| 2013/0121787 | A1 | 5/2013 | Gaw | |
| 2020/0386259 | A1 | 12/2020 | McDermot | |

OTHER PUBLICATIONS

Олег Певцов, Thread in two directions at once., https://www.youtube.com/watch?v=cDfMI5ahbJI, Dec. 14, 2020, entire video.

International Search Report and Written Opinion for PCT/US2022/071861 dated Jun. 29, 2022; 10 pages.

* cited by examiner

DIOPTER ADJUSTMENT FOR OPTICAL DEVICE WITH OVERLAPPING LEFT-HANDED AND RIGHT-HANDED THREADS

TECHNICAL FIELD

The field of the present disclosure relates to optical devices, such as binoculars, riflescopes, spotting scopes and the like, and to diopter adjustments for optical devices, particularly locking diopter adjustments for optical sighting devices.

BACKGROUND

Optical sighting devices, such as binoculars, riflescopes, spotting scopes, and the like, are known to include diopter adjustments for accommodating differences in user eyesight. In binoculars, diopter adjustments on each of the left and right eye channels accommodate for differences between a user's left and right eyes, so that both eyes see the distant scene in sharp focus. In a riflescope, the diopter adjustment enables the user to see the reticle of the riflescope in sharp focus.

A conventional diopter adjustment 8 for a riflescope 10 is illustrated in FIG. 1. The diopter adjustment 8 employs a diopter subassembly 12 including a diopter adjustment lens 13 carried within a movable diopter barrel 14 that is externally threaded. The diopter subassembly is threaded into internal threads of a tubular eyeshell 16, which is attached to the rear end of a main tube 18 or other scope housing of the riflescope 10. An internally-threaded jamb nut or locknut 20 is threaded onto the diopter barrel 14 and is intended to stop and hold the diopter subassembly 12 at a user-selected position in relation to the eyeshell 16 by tightening the locknut 20 against an end surface 22 of the eyeshell 16 and exerting counter-pressure (preload) to increase thread resistance.

A similar adjustable diopter arrangement may be useful for a wide range of other optical devices, but a locking diopter adjustment may be particularly desirable for a riflescope, wherein weapon recoil or adjustment of an optical power selector ring may have a propensity for inadvertently changing the diopter adjustment. However, the present inventor has recognized that diopter adjustment assemblies of the kind illustrated in FIG. 1 are not very effective at stopping or locking the diopter assembly at a desired position, in part because the external threads of the diopter barrel 14, the internal threads of the eyeshell 16, and the internal threads of the locknut 20 are all right-handed threads. The present inventor has recognized that the common thread direction makes the locknut 20 prone to moving along the diopter subassembly barrel when the diopter assembly is twisted clockwise to move the diopter adjustment lens inward toward the eyeshell, instead of stopping adjustment. This is especially true for so-called "fast focus" style diopter adjustments, which include threads having a larger lead and greater helix angle, resulting in reduced thread friction.

Patent Application Publication No. U.S. 2020/0386259 A1 of McDermot et al. attempts to address the problem of stopping or locking a fast-focus diopter adjustment by superimposing fine threads for a jamb nut over the coarser fast-focus threads used for diopter adjustment. Both sets of threads are right-handed, however, so it should be no improvement over a conventional diopter adjustment and may only provide an incremental improvement over a conventional fast-focus diopter adjustment, in terms of stopping or locking performance.

SUMMARY

A diopter adjustment device for an optical device according to the present disclosure includes a first tubular member having external threads, including overlapping left-handed and right-handed threads. The first tubular member is threadably attached to a second tubular member having internal threads so that the internal threads of the second tubular member are mated with either the left-handed or right-handed external threads of the first tubular member. A lens or lens system (also referred to herein as the "diopter lens") is mounted in one of the first and second tubular members and movable therewith relative to the other of the first and second tubular members to adjust a diopter setting or focus of the optical device. The diopter lens may comprise an eyepiece lens system of a riflescope or other optical device. A nut having internal threads that are of opposite handedness as the internal threads of the second tubular member is threaded onto the first tubular member, so that the internal threads of the nut are mated with the external threads of the first tubular member. The nut is rotatable to a selected diopter adjustment position whereat the nut bears against an end of the second tubular member to thereby stop further inward movement of the diopter lens and secure it in place. Because the internal threads of the nut and the second tubular member have opposite handedness, the nut provides greater resistance to inward movement of the diopter lens than conventional locking diopter adjustments.

In some embodiments, the second tubular member is an eyeshell that is affixed to a body or main tube or other major housing component of the riflescope, and the first tubular member is a movable diopter adjustment barrel, with the diopter lens being securely mounted in the diopter adjustment barrel for movement therewith. In other embodiments, the first tubular member is a scope housing or main tube, and the second tubular member is an eyepiece housing, with the diopter lens being securely mounted in the eyepiece housing. Similar diopter adjustment devices can be employed for optical devices other than riflescopes, such as binoculars, spotting scopes, rangefinders, and the like.

In some embodiments, the left-handed internal threads and the left-handed external threads are multi-start threads, and the right-handed internal threads and the right-handed external threads are single-start threads. In other embodiments, the left-handed internal threads and the left-handed external threads are single-start threads, and the right-handed internal threads and the right-handed external threads are multi-start threads. In still other embodiments, the right-handed internal threads and the right-handed external threads are multi-start with a first number of starts, and the left-handed internal threads and the left-handed external threads are multi-start with a second number of starts that may be different from the first number of starts. The pitch of the right-handed external threads may be equal to or different from the pitch of the left-handed external threads to accomplish a desired rate of adjustment while maintaining sufficient stopping power or securement force.

Additional aspects and advantages will be apparent from the following detailed description of preferred embodiments, which proceeds with reference to the accompanying drawings.

DETAILED DESCRIPTION OF PREFERRED EMBODIMENTS

Figure 2:
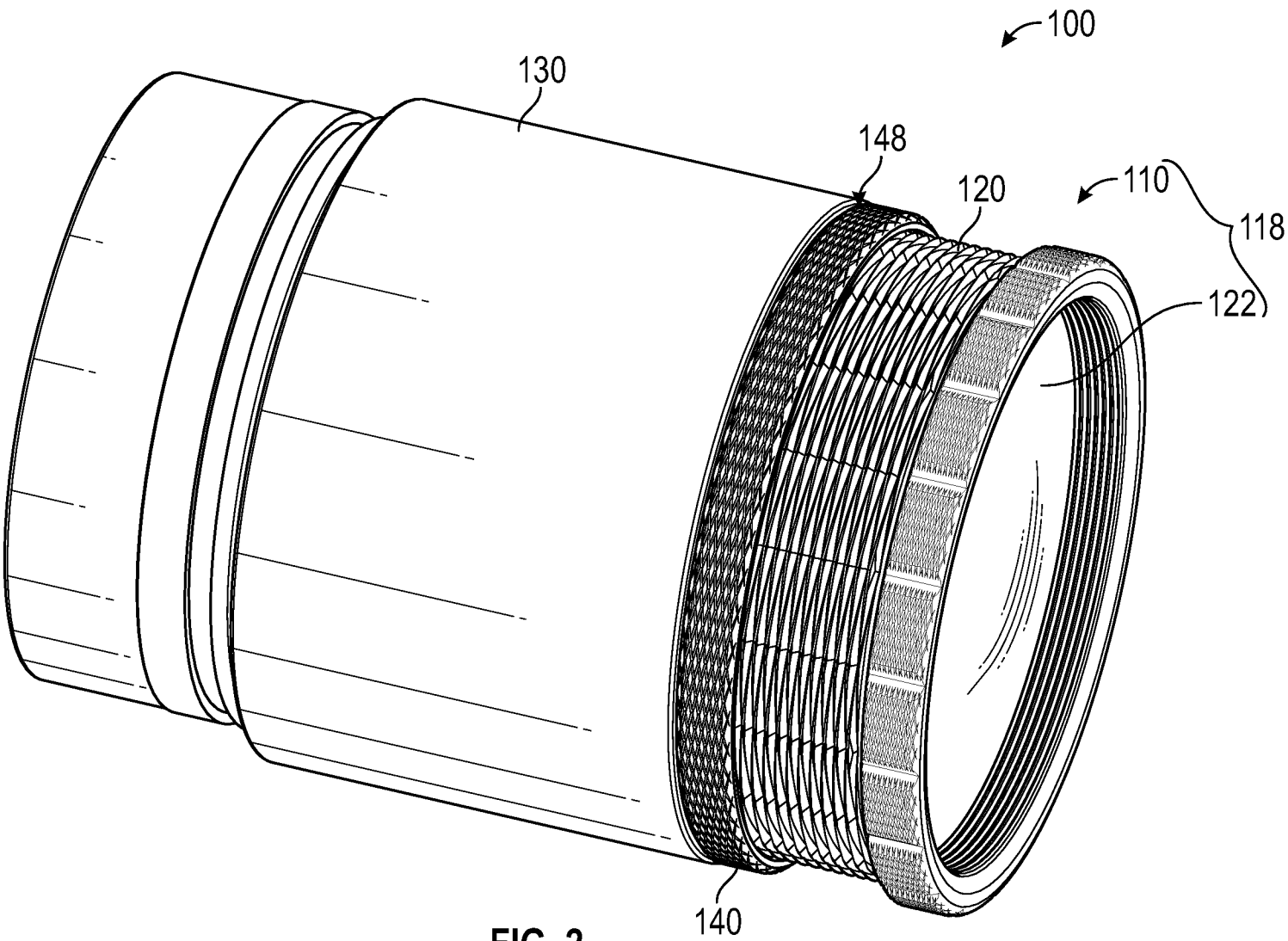
FIG. 2 shows a portion of an eyepiece of a riflescope including a diopter adjustment mechanism according to an embodiment of the present invention.
Figure 3:
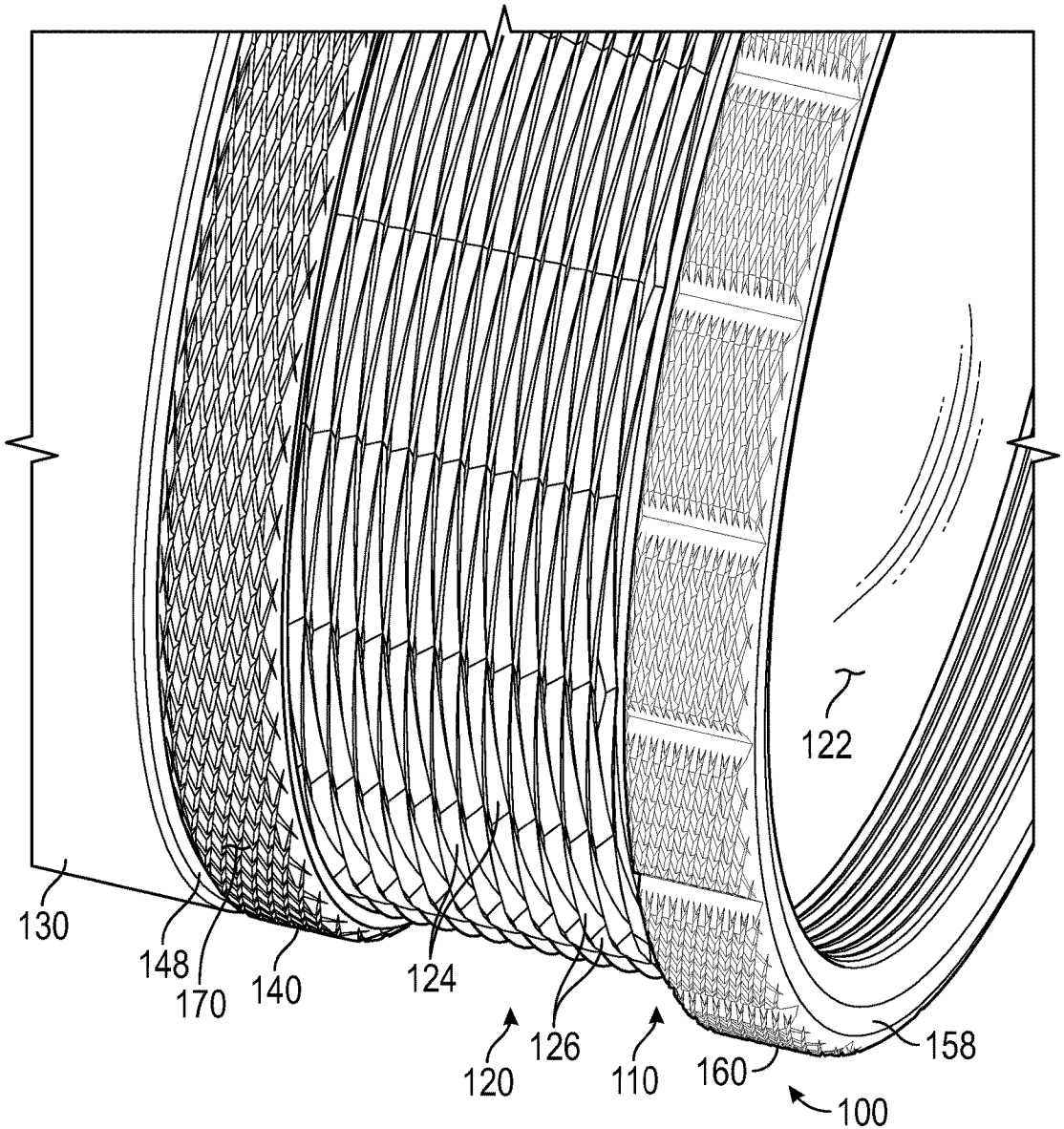
FIG. 3 is an enlarged view of a portion of the diopter adjustment mechanism of FIG. 2, showing detail of overlapping left-handed and right-handed external threads on a barrel of a diopter adjustment subassembly of the diopter adjustment mechanism.
Figure 4:
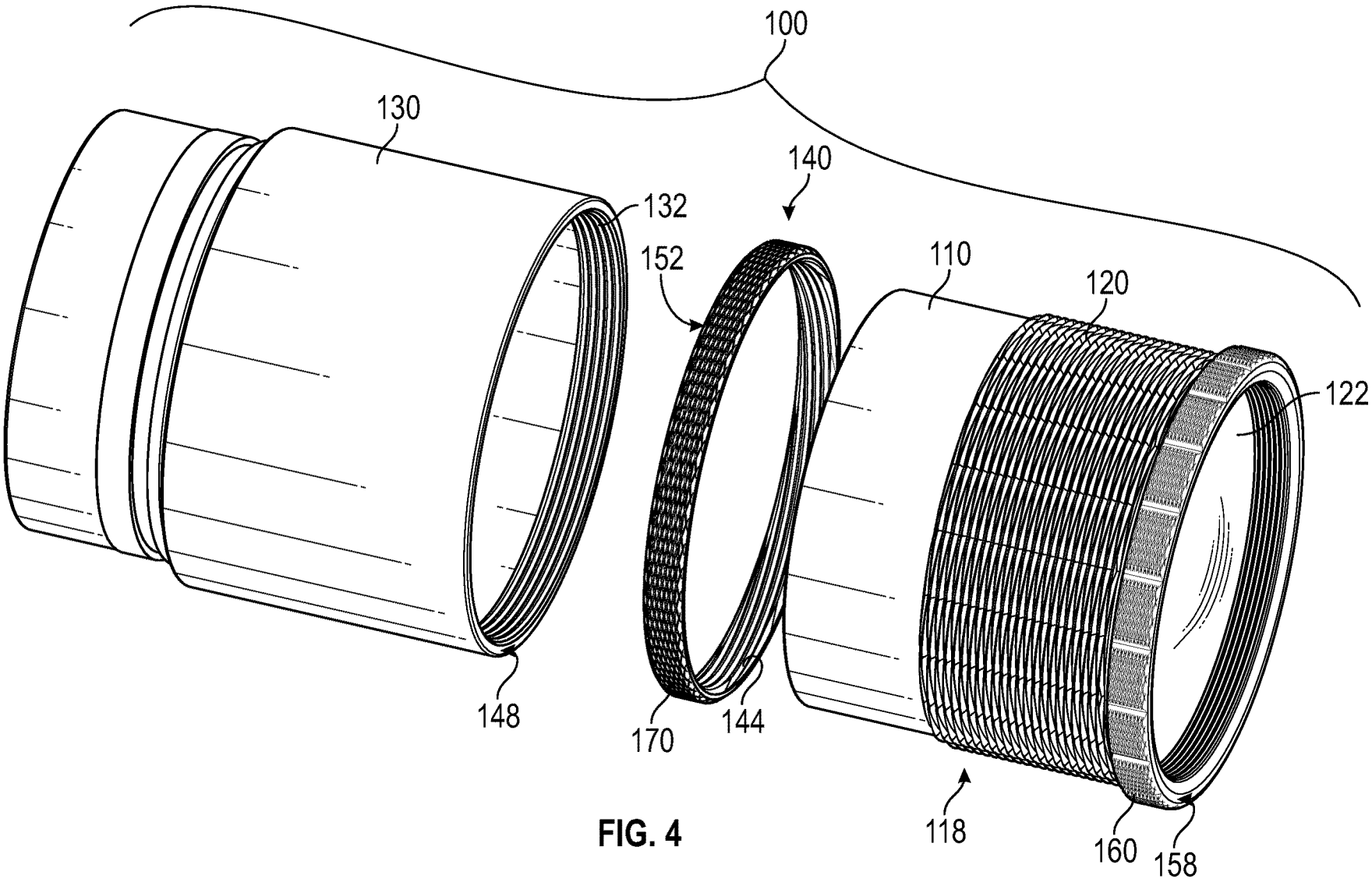
FIG. 4 is an exploded view of the diopter adjustment mechanism of FIG. 2.

FIG. 2 illustrates a diopter adjustment device 100 according to a preferred embodiment, illustrated in the form of an eyepiece unit of a riflescope. Other portions of the riflescope, such as the main tube, turret knobs, objective, and other lenses are omitted from the figures, but are well understood to those skilled in the art. FIG. 4 is an exploded view of the diopter adjustment device 100. With reference to FIGS. 2 and 4, diopter adjustment device 100 includes a first tubular member, referred to herein as a diopter adjustment barrel 110, which has external threads 120 formed or cut therein. A lens 122 or lens system (also referred to herein as a diopter lens) is mounted within diopter adjustment barrel 110 for movement therewith, the diopter adjustment barrel 110 and lens 122 together forming a diopter adjustment subassembly 118. As best illustrated in FIG. 3, which is an enlarged view of a portion of FIG. 2, the external threads 120 include overlapping left-handed external threads 124 and right-handed external threads 126 that crisscross along at least a portion of the length of the diopter adjustment barrel 110. A second tubular member, referred to herein as an eyeshell 130, is provided with internal threads 132 (FIG. 3) which are sized to receive and mate with either the left-handed external threads 124 or the right-handed external threads 126 of the diopter adjustment barrel, depending on the desired handedness of the adjustment device 100. In the embodiment illustrated, the internal threads 132 of the eyeshell 130 are right-handed and mate with right-handed external threads 126, so that clockwise rotation of the diopter adjustment barrel 110 moves the lens 122 closer to eyeshell 130 and counterclockwise rotation of diopter adjustment barrel 110 moves lens 122 away from eyeshell 130, to thereby adjust a diopter setting or focus of the optical device. However, in another embodiment, the thread direction may be reversed so that the internal threads 132 of eyeshell 130 are left-handed and mate with the left-handed external threads 124 so that counter-clockwise rotation of diopter adjustment barrel 110 moves lens 122 closer to eyeshell 130.

A stop nut 140 (which is also sometimes referred to in the art as a jamb nut or locknut) has internal threads 144 that are of opposite handedness as the internal threads of the second tubular member (eyeshell 130), and is threaded onto the first tubular member (diopter adjustment barrel 110), so that the internal threads of the stop nut 140 are mated with the external threads 120 of the first tubular member. In the embodiment illustrated, the internal threads 144 of the stop nut 140 are left-handed and mate with the left-handed external threads 124 of the diopter adjustment barrel 110. The stop nut 140 is rotatable to move the stop nut 140 along the diopter adjustment barrel 110 to a selected position whereat the stop nut 140 bears against an end 148 (FIG. 4) of the eyeshell 130 to thereby stop further inward movement of the diopter lens 122 and secure it in position. The end 148 of eyeshell 130 and an axial side surface 152 (FIG. 4) of the stop nut 140 that faces end 148 may be roughened or textured to increase friction at the interface where stop nut 140 bears on the end 148 of eyeshell 130.

In another embodiment (not illustrated), the first tubular member having overlapping left- and right-handed external threads is a housing or main tube of a riflescope, or a portion thereof; the second tubular member (with internal threads) is an eyepiece housing or eyeshell; and the lens (diopter lens) is securely mounted in the eyepiece housing or eyeshell. In such an embodiment, the nut has internal threads of opposite handedness as the internal threads of the eyepiece housing.

In a riflescope, the diopter adjustment accommodates for differences in eyesight between users, and enables the user to adjust the focus of the eyepiece so the user sees a reticle of the riflescope (not illustrated) in sharp focus. As is well known in the art, the reticle of a riflescope is generally located at or displayed at an internal focal plane of the riflescope superimposed on an image of the distant scene. In riflescopes having significant optical magnification (e.g. greater than about 4x), a separate focus adjustment may be provided for moving other lenses of the riflescope, such as an objective lens or other lens between the objective and the focal plane, for focusing the distant scene at the location of the reticle. U.S. Pat. No. 6,005,711 of Mai et al., which is commonly assigned with the present application and incorporated herein by reference, describes a variable optical power riflescope with a side-focus control and an eyepiece threaded onto the main tube of the riflescope to provide a diopter adjustment.

Figure 1:
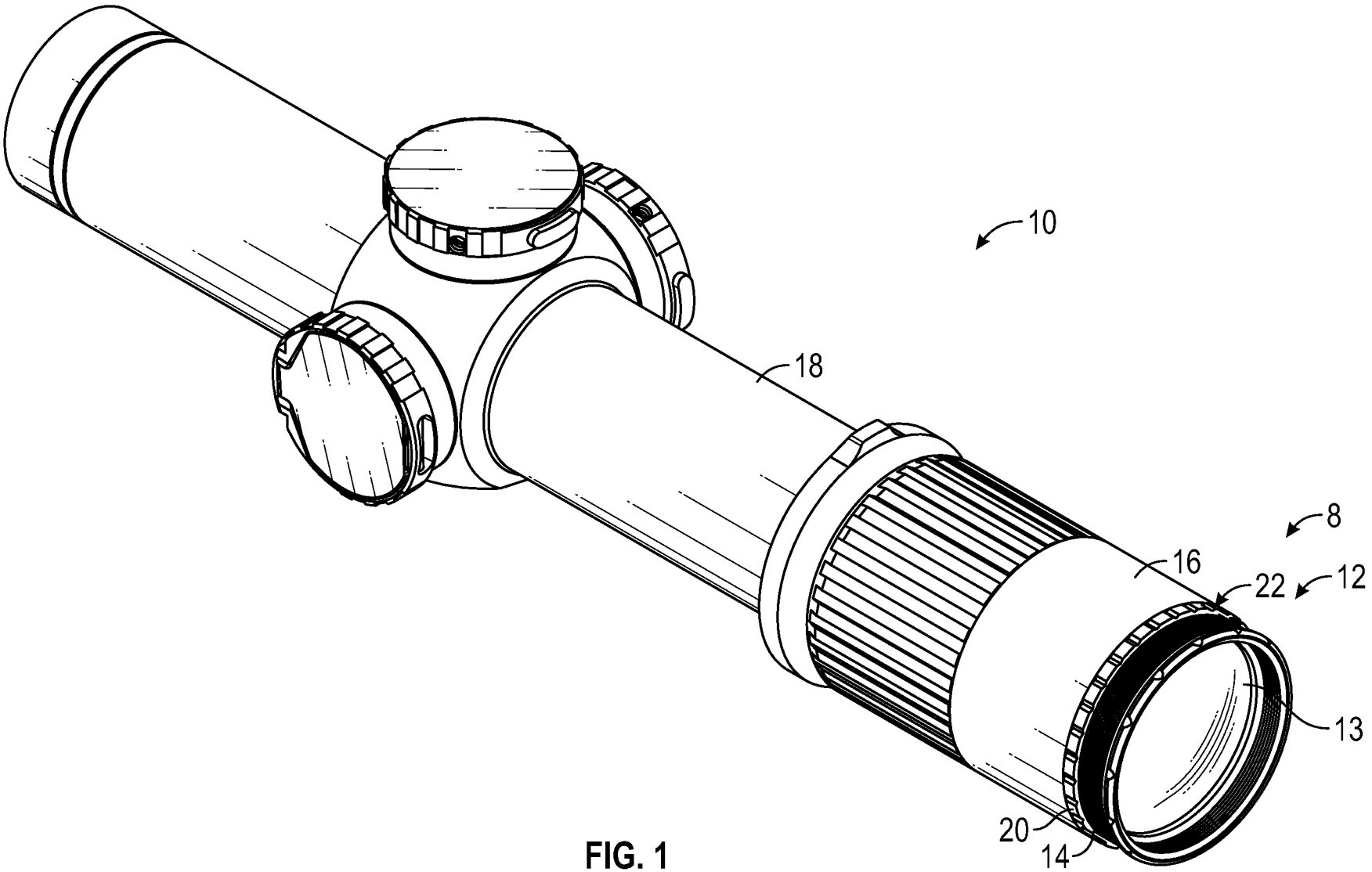
FIG. 1 (Prior Art)
FIG. 1 shows a prior-art diopter adjustment assembly of a riflescope including an internally threaded eyeshell, an internally threaded lock ring, and an externally threaded diopter assembly, all having right-handed threads.

Turning back to FIGS. 1-3, to use the diopter adjustment device 100 the user would typically back off the stop nut 140 away from the eyeshell 130 then adjust the diopter setting by twisting the diopter adjustment barrel 110 to achieve the desired sharp focus of the reticle. After the desired diopter setting is achieved, the user then rotates the stop nut 140 until it bears against the end 148 of the eyeshell 130 and tightens the stop nut 140 to secure the diopter setting against inadvertent adjustment. In the embodiment illustrated, the stop nut 140, which has left-handed internal threads 144, is tightened by rotating it counter-clockwise. Tightening the stop nut 140 against end 148 applies a preload which increases thread friction. Because the internal threads of the stop nut 140 and the eyeshell 130 have opposite handedness, the stop nut 140 provides greatly increased resistance to inward movement of the lens 122 (for example in response to recoil of a weapon to which the riflescope is mounted) than conventional locking diopter adjustments in which all threads are the same handedness, even when the mated threads of the diopter adjustment barrel 110 and eyeshell 130 are so-called "fast focus" threads having a relatively large pitch and/or lead.

For example, in one embodiment the right-handed external thread 126 of diopter adjustment barrel 110 and the right-handed internal thread 132 of eyeshell 130 may be multi-start threads, with 2, 3, 4, 6, 10 or more starts and having a relatively large lead enabling fast-focus performance; and the left-handed internal thread 144 of the stop nut 140 and the left-handed external thread 124 of diopter adjustment barrel 110 may be a single-start thread with a relatively fine pitch and lead. For example, in one embodiment the lead of the right-handed threads 126, 132 may be at least twice as large as the lead of the left-handed threads 124, 144. Alternatively, left-handed internal threads 144 and left-handed external threads 124 may be multi-start threads, and right-handed internal threads 132 and right-handed external threads 126 may be single start threads. In still another embodiment, the right-handed internal threads 132 (e.g. of eyeshell 130) and the right-handed external threads 126 (e.g., of diopter adjustment barrel 110) may be multi-start threads with a predetermined first number of starts (e.g., 2, 3, 4, 6, 10, or more starts), and the left-handed internal threads 144 of stop nut 140 and left-handed external threads 124 (e.g. of diopter barrel 110) may be multi-start threads with a predetermined second number of starts. The second number of starts may be different from the first number of starts. In one embodiment, the first number of starts is greater than the second number of starts.

Advantageously, the right-handed external threads 126 and the mating right-handed internal threads 132 of the second tubular member (eyeshell 130) have a pitch that is approximately equal to a pitch of the left-handed external threads 124 and mating left-handed internal threads 144 of the stop nut 140, to thereby create a regular pattern of overlapping threads on the surface of the diopter adjustment barrel 110 (or other first tubular member) as illustrated in FIGS. 2-4, which is visually distinctive. In an alternative embodiment (not illustrated), the pitch of the right-handed external threads 126 is different from the pitch of the left-handed external threads 124. In some embodiments, the lead of the right-handed external threads 126 may also be different from the lead of the left-handed external threads 124.

The diopter adjustment barrel 110 (first tubular member in this example) preferably includes at its distal end 158 a flange 160 that is knurled or textured to improve gripping when manually rotating the diopter adjustment barrel 110 to adjust the diopter setting. An exterior cylindrical surface 170 of stop nut 140 is preferably also knurled or textured to improve gripping.

The embodiments described above are described in the context of a riflescope including the diopter adjustment device 100. The diopter adjustment devices described herein may also be useful on other types of optical devices, such as binoculars, spotting scopes, and rangefinders.

It will be obvious to those having skill in the art that many changes may be made to the details of the above-described embodiments without departing from the underlying principles of the invention. The scope of the present invention should, therefore, be determined only by the following claims.

The invention claimed is:

1. A diopter adjustment device, comprising:

a first tubular member having external threads;

a second tubular member having internal threads, the first and second tubular members being threadably attached so that the internal threads of the second tubular member are mated with the external threads of the first tubular member;

a lens mounted in one of the first and second tubular members; and a nut having internal threads and threaded onto the first tubular member, so that the internal threads of the nut are mated with the external threads of the first tubular member, the external threads of the first tubular member including right-handed external threads and left-handed external threads, the right-handed and left-handed external threads overlapping each other, and the internal threads of one of the second tubular member and the nut being left-handed and the internal threads of the other of the second tubular member and the nut being right-handed.

2. The diopter adjustment device of claim 1, wherein the nut is adjustable to bear against an end of the second tubular member and thereby stop further inward movement of the lens.

3. The diopter adjustment device of claim 1, wherein:

the second tubular member is an eyeshell, the first tubular member is a diopter adjustment barrel, and the lens is securely mounted in the diopter adjustment barrel for movement therewith.

4. The diopter adjustment device of claim 1, wherein:

the first tubular member is a scope housing, the second tubular member is an eyepiece housing, and the lens is securely mounted in the eyepiece housing.

5. The diopter adjustment device of claim 1, wherein the left-handed internal threads and the left-handed external threads are multi-start threads, and the right-handed internal threads and the right-handed external threads are single-start threads.

6. The diopter adjustment device of claim 1, wherein the left-handed internal threads and the left-handed external threads are single-start threads, and the right-handed internal threads and the right-handed external threads are multi-start threads.

7. The diopter adjustment device of claim 1, wherein the right-handed internal threads and the right-handed external threads are multi-start threads with a first number of starts, and the left-handed internal threads and the left-handed external threads are multi-start threads with a second number of starts.

8. The diopter adjustment device of claim 7, wherein the first number of starts is different from the second number of starts.

9. The diopter adjustment device of claim 1, wherein the right-handed external threads have a pitch that is equal to a pitch of the left-handed external threads.

10. The diopter adjustment device of claim 1, wherein the right-handed external threads have a pitch that is different from a pitch of the left-handed external threads.

11. The diopter adjustment device of claim 1, wherein the first tubular member includes a flange at a distal end, and the flange is knurled or textured.

12. The diopter adjustment device of claim 1, wherein an exterior surface of the nut is knurled or textured.

13. An optical sighting device including the diopter adjustment device of claim 1.

14. The optical sighting device of claim 13, wherein the optical sighting device is a riflescope.

* * * * *